US010905615B2

(12) United States Patent
Blackwell

(10) Patent No.: US 10,905,615 B2
(45) Date of Patent: Feb. 2, 2021

(54) PATIENT POSITIONING APPARATUS, SYSTEM AND METHOD WITH SOCKET CONNECTOR FOR POSITIONING PATIENT IN LATERAL POSITION

(71) Applicant: Innovative Medical Products, Inc., Plainville, CT (US)

(72) Inventor: Timothy Blackwell, Plainville, CT (US)

(73) Assignee: Innovative Medical Products, Inc., Plainville, CT (US)

( * ) Notice: Subject to any disclaimer, the term of this patent is extended or adjusted under 35 U.S.C. 154(b) by 431 days.

(21) Appl. No.: 15/891,335

(22) Filed: Feb. 7, 2018

(65) Prior Publication Data

US 2018/0256429 A1 Sep. 13, 2018

Related U.S. Application Data

(60) Provisional application No. 62/470,867, filed on Mar. 13, 2017.

(51) Int. Cl.

| | |
|---|---|
| ***A61G 13/12*** | (2006.01) |
| ***A61G 13/10*** | (2006.01) |
| ***A61G 13/00*** | (2006.01) |

(52) U.S. Cl.

CPC ..... *A61G 13/1295* (2013.01); *A61G 13/0081* (2016.11); *A61G 13/101* (2013.01); *A61G 13/123* (2013.01); *A61G 13/1225* (2013.01); *A61G 13/1285* (2013.01)

(58) Field of Classification Search

CPC .. A61G 13/101; A61G 13/12; A61G 13/1225; A61G 13/123; A61G 13/1285; A61G 13/1295

USPC ..... 128/121.1, 122.1, 125.1, 845

See application file for complete search history.

(56) References Cited

U.S. PATENT DOCUMENTS

| | | | | |
|---|---|---|---|---|
| 6,298,507 | B1 | 10/2001 | Clyburn | |
| 6,311,349 | B1 * | 11/2001 | Kazakia | A61G 13/12 128/845 |
| 6,820,621 | B2 | 11/2004 | DeMayo | |
| 7,426,930 | B1 | 9/2008 | Bailey et al. | |
| 8,256,047 | B2 * | 9/2012 | Klemm | A47C 16/00 128/845 |
| 8,286,283 | B2 * | 10/2012 | Copeland | A61G 13/12 128/845 |

* cited by examiner

*Primary Examiner* — Keri J Nelson

(74) *Attorney, Agent, or Firm* — Damian Wasserbayer, Esq.; Wasserbauer Law LLC

(57) ABSTRACT

A support system for positioning a patient in lateral position during surgery procedures with a removable, adjustable support pad assembly, comprising a first support unit arranged for attachment to side rail on a lateral edge of an operating table, and a second support unit comprising an arm connected movably by the using of a movable connection with a pad plate adapted to position a support pad connected by a biasing connector to a support plate with degrees of freedom of angular rotational movement of the support pad in relation to the patient. The biasing connector comprises a channel formed between a base plate support segment and a projection clamping the pad plate apart from the support plate to allow flow of air and/or fluids from the support pad.

17 Claims, 4 Drawing Sheets

PATIENT POSITIONING APPARATUS, SYSTEM AND METHOD WITH SOCKET CONNECTOR FOR POSITIONING PATIENT IN LATERAL POSITION

CROSS-REFERENCE TO RELATED APPLICATION

This application claims the benefit of U.S. Provisional Application No. 62/470,867, filed Mar. 13, 2017.

FIELD OF THE INVENTION

The subject of the invention is a support apparatus, system and method for positioning patient in lateral position during surgery procedures using an improved socket connector assembly.

BACKGROUND OF THE INVENTION

Conventional support systems are widely used during specific surgery procedures, like hip arthroplasty or hip fracture, which require stabilization of a patient in one lateral position for many hours. In order to provide an access to the surgical site, it is often necessary to place patient in an unnatural position, simultaneously maintaining patient safety and comfort.

Conventional support systems for positioning a patient in lateral position during hip replacement or hip surgery typically consist of a sacral support unit arranged for attachment to an operating table and a pelvic support unit. The pelvic support unit comprises an extension arm enabling height adjustment, a horizontal arm enabling width adjustment and rotary arm ended with a pelvic support plate. In these support systems, the support plate is rigidly attached to the rotary arm without possibility of changing its angular position. Moreover, the solution itself does not solve the problem of abrasions occurring during surgery procedures, as a result of contact between support elements and the skin of the patient.

Other support systems are configured as an adjustable table attachment apparatus adapted for attachment to an operating table and supporting patient in lateral position during surgery procedures. Such adjustable table attachment apparatus comprise a generally U-shaped tubular frame having vertical legs adapted at their lower ends to be removable received and secured on opposed sides of an operating table and rectangular top platform having one end adapted to be removable attached to horizontally-extending rail of U-shaped frame. The U-shaped frame comprises also two pelvic positioners connected with the padded plates made of the rigid material by means of rigid connection to an end a pelvic positioner. Consequently, movement of the padded plates is limited as the padded plate is oriented in a transverse plane spinning around the connection on the end of an arm the pelvic positioner is possible before orienting adjacent the patient in the chosen immobile position. The rigid construction of the padded plates in the transverse plane provides no possibility of combined angular and rotational movement. The rigid padded plate of these adjustable table attachment apparatus is uncomfortable, has lower adaptation of the apparatus to the anatomical construction of the patient, and may result in a high risk of skin abrasions and/or trauma.

Other a surgical support devices comprising a rigid support plate arranged for attaching to a hospital bed with upstanding front and rear support. The front support apparatus typically comprises a top and bottom arm terminating in top and bottom patient support pads, wherein a top patient support pad is made of compression foam material and removably attached to the top plate by using of a top plastic clip on one side thereon. This solution provides greater patient comfort during contact with a support device, but due to the lack of angular and rotational movement of the support pad, the surgical support does not solve the problem of slipping of the obese or otherwise oversized patients as the support plate is in a fixed position.

The prior art solutions are not sufficiently adapted for stabilizing position of wide range of physical sizes of patients. It would be desirable therefore to provide a support system allowing wide dimensional adjustment range, preventing slipping off the obese patients, which does not result in unnecessary pressure on the surface of the patient's skin, at the same time.

SUMMARY OF THE INVENTION

The disadvantages of the prior art solutions are solved by a support system according to the invention.

The invention comprises a support system for positioning patient in a lateral position during surgery procedures, comprising a first support unit arranged for attachment to a lateral edge of an operating table, the support unit comprising a bottom plate, a first high adjustable arm and a second length adjustable arm and a second support unit comprising a rotatable curved arm connected movably by the using of connection means with a pad plate, the second support unit comprising moreover a support plate. The support system according to the invention is characterized in that the pad plate is arcuate, curved, oval or round-shaped. Moreover, the support plate comprises on the surface thereof an oval plate with elastic segmented projections for clamping the pad plate to the support plate and permitting an angular rotational movement of the support plate in relation to the pad plate.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 1:
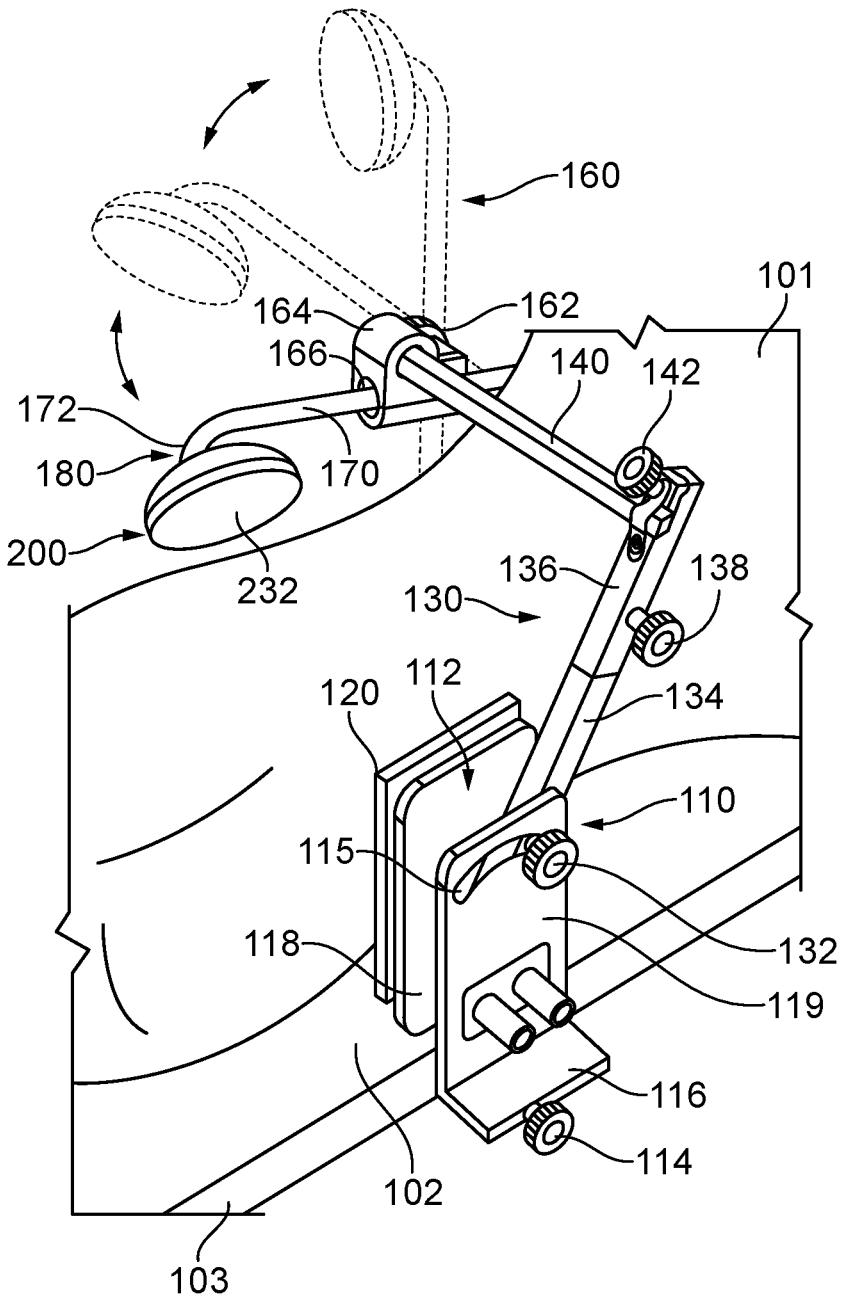
FIG. 1 is a perspective view illustrating the first embodiment of a support system according to the invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

FIG. 1 shows schematically the first embodiment of a support system 100 for positioning and holding a patient 101 on an operating room or other support table 102 according to the invention. The support system 100 comprising a first support unit 110 attached to a side rail 103 located on a lateral edge of the operating room (OR) table 102 and a second support unit 160. The first support unit 110 according to this embodiment of the invention for positioning a patient 101 for hip surgery. The first support unit 110 comprises a side rail plate assembly 112, a first adjustable arm 130, having telescopic arm segment 134 configured to be received in arm segment 136 and a second length adjustable arm 140 for positioning on the patient 101, for example, the lumbar region of the patient 101, and the iliac crest and/or pelvic region 199. Each of the first telescopic arm 130 and second length adjustable arm 140 may be formed from tubing of varying shapes for example, circular, square, solid and/or hollow tubular stock.

The side rail plate assembly 112 comprises one horizontal plate 116 and two vertical plates 118, 119. The horizontal plate 116 comprises an adjustment knob 114 for adjustment of position of the side rail plate assembly 112 and securing to the side rail 103 of the OR Table 102. The vertical plate 118 may be configured with a lumbar pad 120 in direct contact at the lumbar portion with the patient's body 101. Another vertical plate 119 includes a radial slot 115 for rotatable adjustment of the first telescopic adjustable arm 130 and secured by the associated knob 132 in the construction of telescopic adjustable arm 130. The telescopic adjustable arm 130 comprises a knob 138, an arm segment 134 and arm segment 136, whereby the arm segment 134 is configured to be received in arm segment 136. The arm segment 134 is adapted to receive the fastener of the knob 132 for establishing and holding an angular position of the first arm 130. The arm segment 136 is configured of a larger dimension than the arm segment 134 so as to receive arm segment 134 therein. The arm segment 136 is adapted with an opening located on arm segment 136 to receive a securing fastener associated with the adjustment knob 138 for adjustment of height of the adjustable arm 136. The adjustment knob 138 is configured to secure the arm segments 134, 136 in a desired position, for example, allowing regulation of height of the telescopic adjustable arm 130 and for securing in a desired position relative to the patient 101.

As shown in FIG. 1 the first telescopic adjustable arm 130 and the second length adjustable arm 140 are connected by the using of knob 142 and for securing in a desired position. According to this embodiment of the invention a knob 142 connects the second length adjustable arm 140 with the second support unit 160 and knob 162 operably connecting the connector 164 to receive the arm 170 in the opening 166 formed in the body of the connector 164 allows manipulating of position of a rotatable curved arm 170 relative to the length adjustable arm 140. The rotatable curved arm 170 is connected movably through degrees of movement being disposed in the opening 166 of the connector 164 and tightened or loosened by the knob 162. A pad plate 202 is configured to be operably connected for angular movement relative to the arm 170, as shown in FIG. 1.

Referring to FIGS. 1-5, the pad plate 202 is configured to operably connect with a support plate 220 and a support pad 230 affixed thereto by the segmented projections of a biasing connector 240. The biasing connector 240 may be formed of plastic as a part of support plate 220 configured to connect to the pad plate 202. The support pad 220 in this embodiment of the invention is formed in an oval-shape and made of compressive foam material and is in contact with the body part of the patient 101. The support pad 230 may further have a construction of a support pad 230 of a density of gel, foam, closed cell memory foam, or other suitable compressive material, e.g. firm, and another support pad 232 of another density of compressive foam material, e.g. soft so as to provide better adaptation to the anatomical construction of the patient 101 and eliminates the risk of the skin abrasions. The support plate 220 is angularly rotationally movable as connected to the pad plate 202 under the influence of an external force F1, exceeding the threshold value being the friction force F2 between segmented projections 240 and the pad plate 202 so as force or press against the patient 101 to support and hold the patient 101 in a desired position for a surgical procedure.

Figure 2:
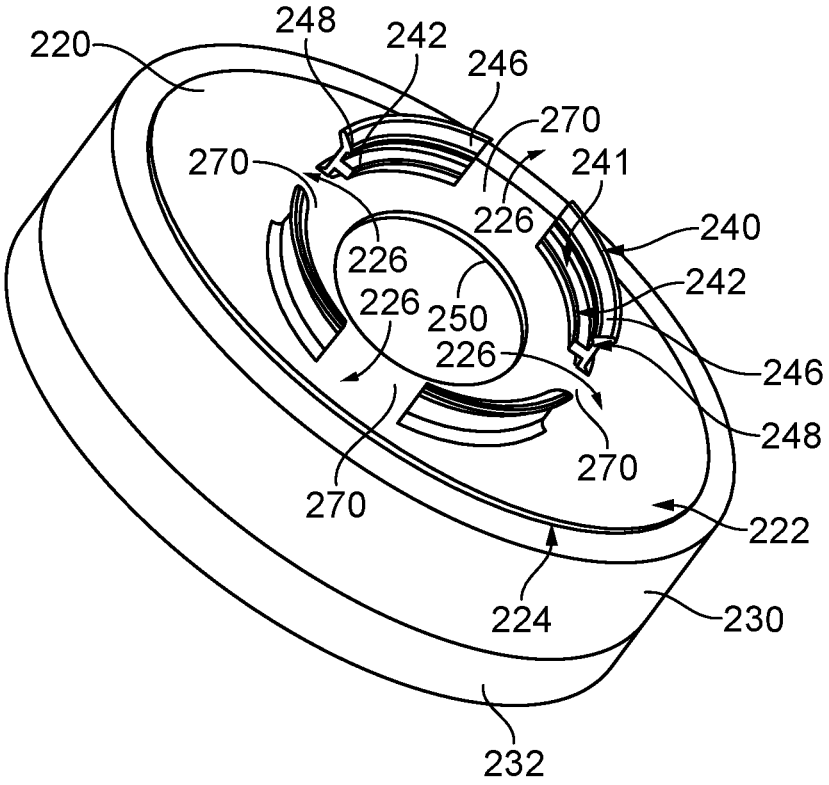
FIG. 2 is a perspective view illustrating an oval plate with elastic segmented projections of the support system according to FIG. 1.

FIG. 2 shows in details the construction of the support plate 220 comprising a biasing connector 240 with segmented projections according to the first embodiment of the support system 100. The biasing connector 240 may be configured on a portion of the upper surface 220 with intervals 270, for example, centrally located to project on an upper surface 220 of the surface of the support plate 220 for positioning adjacent a circle plane of the pad plate 202 in a channel 241. On a lower surface 224 of the support plate 220 is configured to secure and affix the support pad 220 thereto so as to be positioned adjacent the patient 101, which securing may be accomplished by adhesives. In this embodiment of the invention the support plate 220 is configured in four segmented spring connections 240, identical in design, and four intervals 270. The spring connections 240 may be configured approximately T-shaped in cross-section and have an elongated base plate support segments 242, e.g. a protruding part of the T-shaped cross section. The spring connections 240 may be configured with a protrusion 246 with a lip 248 (e.g. tooth-like) inclined at an angle to the upper surface 222 of the support plate 220. The spring connections 240 may be configured with a channel 241 for holding edge 207 of the pad plate 202 so as to secure the pad plate 202 to the support plate 220. The base plate support segment 242 is configured to support the pad plate 202 in spaced relation a distance apart from the support plate 220 parallel to the surface of the support pad 230. The base plate support segments 242 and projections 246 may be configured with the diameter smaller than diameter of the edge 207 of the pad plate 202 which are arranged in a plane above the surface of the support plate 220, permitting maintenance of the pad plate 202 on the base plate support segments 242. An opening 250 may be formed extending through the upper surface 222 and lower surface 224 of the support plate 220 to allow passage of air and/or fluids that may accumulate in the support pad 230 whereby such fluids can flow 226 and emanate from the support plate opening 250.

Figure 3:
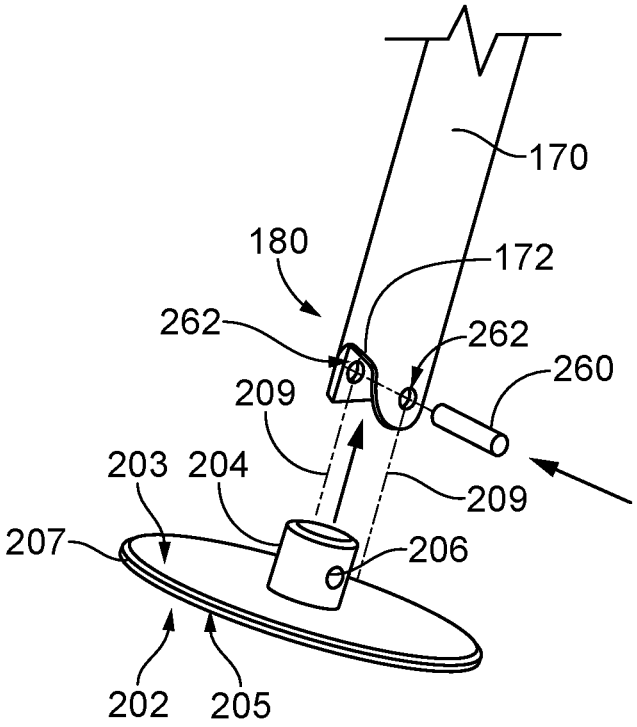
FIG. 3 is a perspective view illustrating a rotatable curved arm connected with a pad plate of the support system according to FIG. 1.
Figure 4:
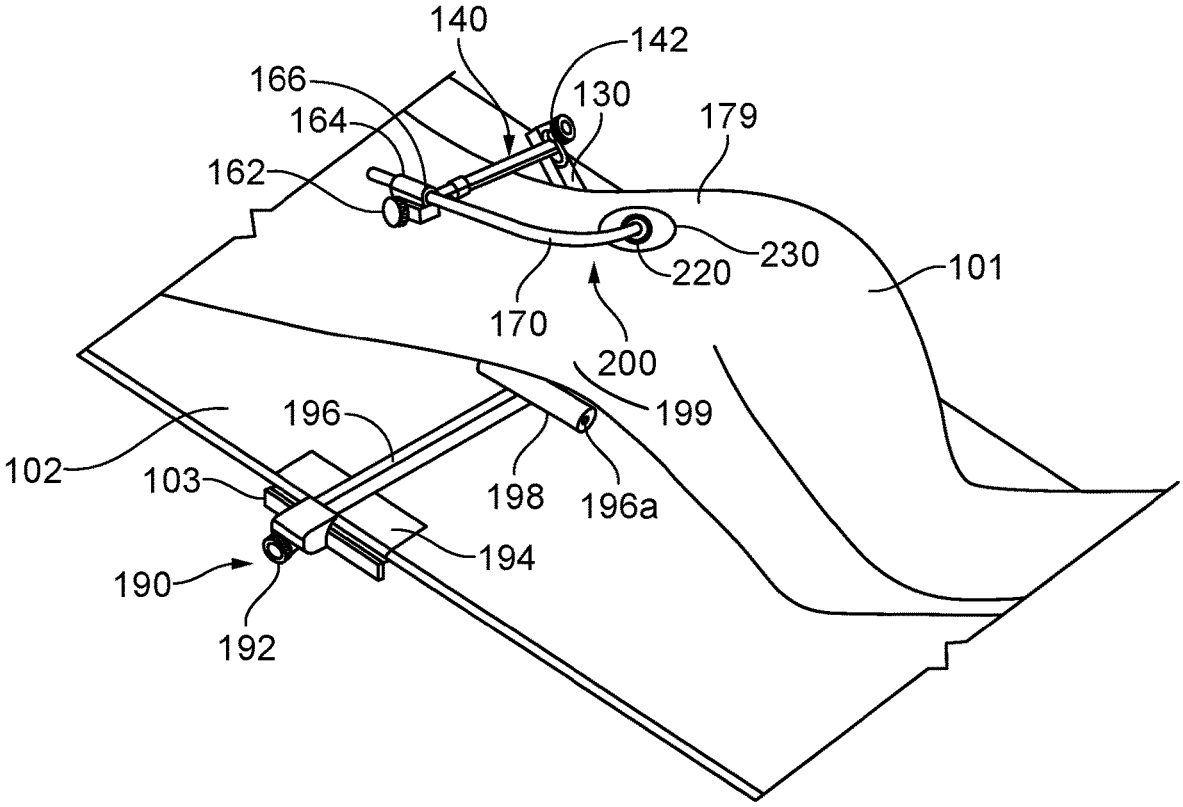
FIG. 4 is a perspective view of the second embodiment of a support system with a third support element.

As shown in FIG. 3 the rotatable curved arm 170 is connected with pad plate 202 by the using of connection 180, which in this embodiment of the invention comprise a pin 260 disposed through openings 206, 262 to join a post 204 in the slot 172 formed in the arm 170 in a rotatable connection. According to this embodiment of the invention the slot 172 is configured on the end of rotatable curved arm 170 of a dimension enabling degrees of freedom movement of the post 204, pad plate 202, and any attached support plate 220 and support pad 230. In operation, the arm 170 can force the support pad 230 and/or 232 against the upper iliac crest 179, with angular displacement of the pad plate 202 attached to arm 170 resulting in the support pad 230 and/or 232 adjusting to the anatomy of the patient 101 to support and hold in the desired position as illustrated in FIGS. 1-4. Similarly, a ball and socket connector assembly 180 between the arm 170 and pad plate 220 can force the support pad 230 and/or 232 against the upper iliac crest 179 resulting in the support pad 230 and/or 232 adjusting to the anatomy of the patient 101 to support and hold in the desired position as illustrated in FIGS. 4 and 5.

FIG. 4 shows a second embodiment of the support system 100 with a third support element 190 mounted to the opposite side rail 103 on a lateral edge of the operating table 102 relative to the first support unit 110. The third support element 190 comprises the bottom plate 194, horizontal arm 196, crossbar **196*a*, and crossbar pad 198 operably connected to the crossbar 196*a* mounted to the third support element 190 for supporting the pelvic area and/or lower anterior iliac crest 199 to maintain the patient 101 in the desired stationary position. In this embodiment of the invention the bottom plate 194 of the third support element 190 comprises moreover an adjustment knob 192 allowing adjusting of the third support element 190 along side rail 103 of the operating table 102. In operation, the third support element 190 can force the crossbar pad 198 against the pelvic region and/or iliac crest 199 of the patient 101 to support and hold in the desired position as illustrated in FIG. 4**.

Figure 5:
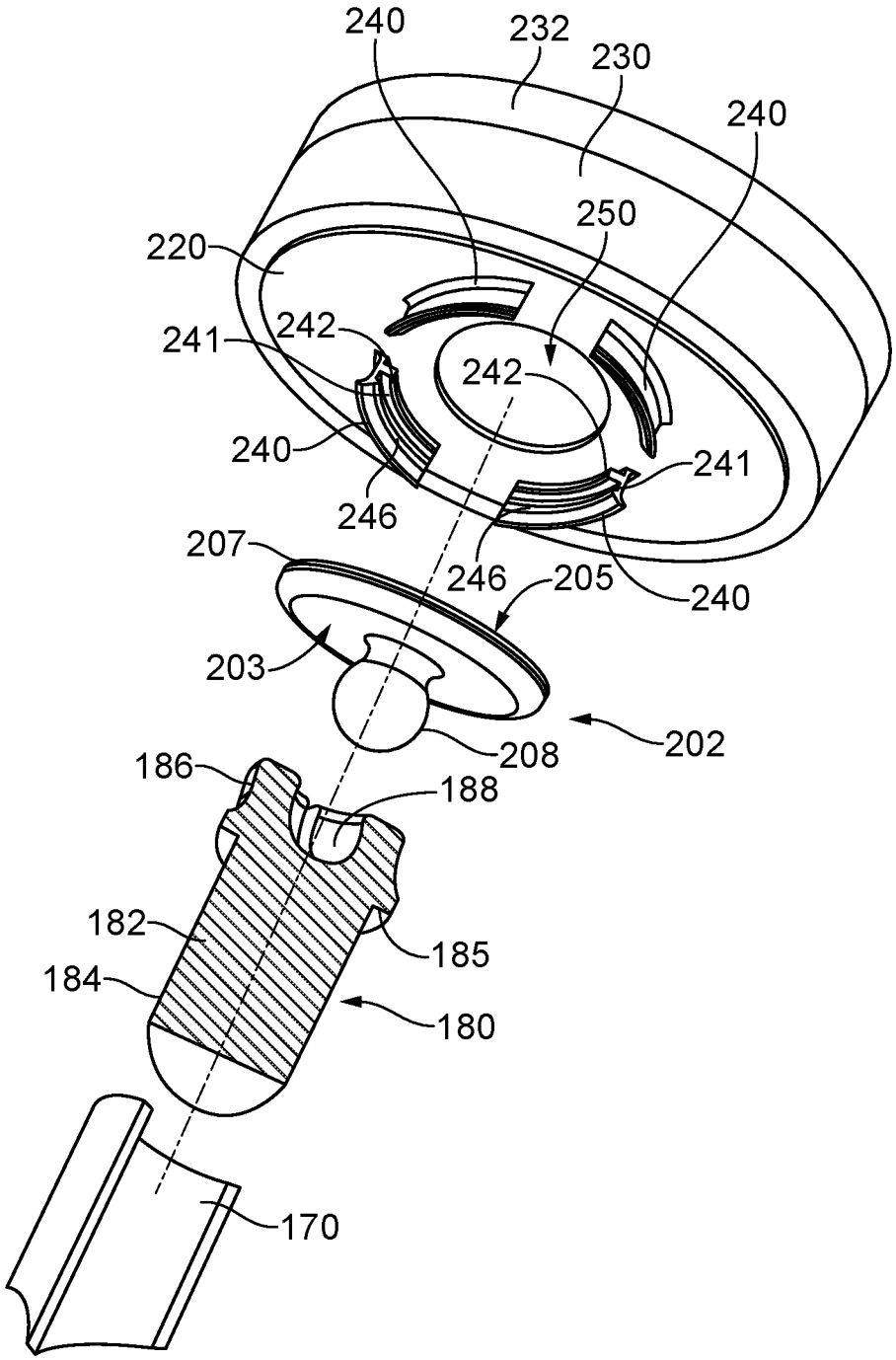
FIG. 5 is a perspective, schematic view illustrating an alternative arm, support plate and pad plate connection according to the invention.

Referring to FIGS. 2-3 and 5, the support system 100 according to the invention is characterized by the support plate 220 being angularly rotationally thereby making movable around the pad plate 202 under the influence of an external force F1, exceeding the threshold value. It is therefore possible to eliminate the risk of undesirable displacement of the support plate 220 from the adjusted position. Referring to FIGS. 2 and 5, the support system 100 comprises a biasing connector 240 consisting of base plate support segments 242 with one or more protrusions 246 extending to support a lower surface 205 of the pad plate 202 and each elongated protrusion 246 having a lip or tooth end 248 extending beyond a forward face or upper surface 203 surrounding the edge 207 of a portion of the pad plate 202 so as to secure the support plate 220 to the pad plate 202. The biasing connector 240 comprises intervals 270 forming the elastic segmented projections 240 allowing for the support pad 230 to be operably connected to the base plate 202 of the pad assembly 200. The biasing connector 240 may be formed from suitable materials having elastomeric properties, resistant to bending and abrasions, including of metals, metal alloys, polymers and elastic materials. The use of these types of materials allows for clamping of the pad plate 202 easily to the support plate 220 and simultaneously prevents surface damages in the point of contact between the base plate support segments 242 and protrusions 246, along with the protrusions 246 and lips 248 securing the edge 207 of the pad plate 202 therein.

Referring to FIGS. 2-3 and 5, the support system 100 according to the invention is characterized in that the segmented projections of the biasing connector 240 are arranged on the upper surface 222 of the support plate 220 that can be formed to allow for the clamping of the pad plate 202 easily to the support plate 220, for example, in a circle with intervals 270 on the support plate 220 structure. This type of construction simplifies the rotational movement of the support plate 220 in relation to the pad plate 202 by reduction of numbers of points of contact between support plate 220 and pad plate 202 and therefore the friction force between them. Moreover, this arrangement increases the possible range of angular positioning of the rotatable curved arm 170 as shown in FIG. 1, for example, to 180° degrees, thereby allowing the rotatable curved arm 170 to engage the anatomy of the patient 101 to force and/or press the support pad 230 against the patient 101 using the lower surface 205 of the pad plate 202.

Referring to FIGS. 2-3 and 5, the support system 100 is characterized in that the segmented projections 240 are configured for securing an edge 207 of the pad plate 202 within a channel 241 formed by the protrusion 246 of the base support segment 242 and the lip 248 of the protrusion 246 in the biasing connector 240 as shown in FIGS. 2 and 5. The segmented projections of a biasing connector 240 may be formed approximately T-shaped in cross-section having the protruding part of the T-shaped cross-section being the elongated protrusion 246 for supporting the pad plate 202 by plate support segments 242. Similarly, the upper surface 203 of the pad plate 202 engages protrusions 246 for securing edge 207 in the channel 241 by the lip 248 of the protrusion 246 as shown in FIGS. 2 and 5. The protrusion 246 and lip 248 may be formed inclined at an angle to upper surface 203 of the pad plate 202 for securing edge 207 in the channel 241 and for seating the lower surface 205 against the protrusion 246 thereby suspending the pad plate 202 above the upper surface 222 of the support plate 220 forming a flow channel 226 for air, fluids and the like emanating from the opening 250, for example, air and/or fluids can seep into the support pads 230, 232 and be released through the opening 250 and out the intervals 270. The flow 226 of air through the opening 250 has advantages in removing trapped air from the support pad 230 and/or 232 for improved securing of the patient 101 in the support system 100 and also providing increased comfort to the patient 101 by allowing any trapped air to escape thereby decreasing abrasions, hot spots and/or damage to tissue. Consequently, the support system 100 of the invention improves the function of maintaining the patient 101 in the fixed position using arm 170 engaging the pad assembly 200 against the anatomy of the patient 101, e.g. with the support pad 230 connected to the support plate 220 angularly engaging the patient 101 to the support arm 170 as being rotatably connected to the pad plate 202 by the connection 180 of, for example, the pin 260 engaging the slot 172 in the arm 170 and opening 206 in the post 204 and/or using the ball and socket connector assembly 180. A rotatable connection 180 is configured to operably connect the pad plate 202 in the channel 241 formed by the baseplate support segments 242 and lip 248 and the other parts of construction of the segmented projections of a biasing connector 240, as illustrated in FIGS. 3 and 5. At the same time, the pad plate 202 is easily removable from the channel 241 as the protrusion 246 of the biasing connector 240 releases from the segmented projections 240. The pad plate 202 can engage the channel 241 of the support plate 220 by pressing the oval plate into the biasing connector 240. This type of construction of the invention advantageously provides removal of the pad plate 202 from the support plate 220 so that the support pad 230 and/or support pad 232 can be removed after the surgical procedure for reuse of the support system 100 after sterilization.

Referring to FIG. 2, the support system 100 according to the invention is characterized in that pad plate 202 is elevated above the support plate 220 by the lower surface 205 being supported by projections 242 so as to form flow 226 through intervals 270. Moreover, the support plate 220 comprises a support plate opening 250 extending between the surfaces 222 and 224 thereof with the flow 226 of air and/or fluids out of opening 250 for release of any fluids trapped in the support pad 230 and/or any trapped air that leads to elimination of the friction force against the patient 101.

Referring to FIGS. 2 and 5, the support system 100 according to the invention is characterized in that edge 207 of the pad plate 202 has diameter lower than the diameter of circle of biasing connector 240 for operably connecting thereby and forming an operably biasing connection on the plane of which the segmented projections are arranged of biasing connector 240. This construction of the pad assembly 200 allows rotation of the pad plate 202, support plate 220, and the support pad 230 and or 232 relative to the arm 170 that lead improved positioning, greater patient comfort, flow 226 of air and or fluids from the pads 230 and/or 232, and elimination of the friction force against the patient 101. Diversification of mentioned diameters enables maintaining the pad plate 202 in the channel 241 elevated above the upper surface 222 and simultaneously reduces the friction between the pad plate 202 and the support plate 220. Furthermore the support system 100 according to the invention is characterized in that the support plate 220 utilizes an oval structure with a round arrangement of biasing connector 240 for connecting to the round pad plate 202. The application of movability of the pad plate 202 and support plate 220 respective of the arm 170 and anatomy of the patient 101 leads to elimination of the friction force between the pad plate 202 and the oval structure of the support plate 220 and thus the abrasion of materials of which these constructional elements are made to the patient 101.

Referring to FIGS. 2 and 5, the support system 100 according to the invention is characterized in that the support pad 230 is oval-shaped and made of compressive foam material. The support system 100 using the support pad 230 on the adjustable pad plate 202 provides better adaptation to the anatomical construction of the patient 101 and eliminates the risk of the skin abrasions. Moreover, the support pad 230 can be combined with another support pad 232 comprised of a different density to provide improved adaptation to the anatomical construction of the patient 101 and eliminates the risk of the skin abrasions Referring to FIGS. 1-5, the support system 100 according to an embodiment of the invention is characterized by an operable connection between the support arm 170 and the pad plate 202 consisting of pin 260, opening 262 in the arm 170, and the opening 206 in the post 204. A slot 172 arranged on the end of the rotatable curved arm 170 is adapted to receive the post 204 extending from the upper surface 203 of the pad plate 202 and the pin 260 operably connects these structures, as shown by path 209 through the openings 206 and 262, by passing the pin 260 through openings 206, 262 positioned adjacent each other thereby allowing the pad plate 202 to rotate angularly in the slot 172 as shown in FIG. 2. This connection enables performing multiple degrees of movement of the pad plate 202 relative to the arm 170. The advantage of this solution is the ability to angular rotational movement of the pad plate 202 and/or the support plate 220 enables finding the best possible support for the patient 101, independently from the weight and physical size of the patient 101. At the same time, support system 100 maintains the patient 101 in the immobile, chosen position reducing the risk of the undesirable rolling of the patient 101 on the one side and eliminates the problem of skin abrasions occurring during surgery procedures from the support system 100 to the patient 101.

According to another embodiment of the invention illustrated in FIG. 5, a connection assembly 180 may be formed in a ball and socket configuration to form the movable connection between the pad plate 202 relative to the arm 170 having a full range of degrees of movement. The connection assembly 180 comprises a body 182 having a connection portion 184 slidably received in the arm 170 stopping at a flange 185, and a plate connection portion 186 on a opposite side of flange 185 configured with a socket portion 188. The pad plate 202 can be configured with a ball post 208 configured to be received in the plate connection portion 186 with the connection 180 enabling full degrees of movement of the pad plate 202 relative to the arm 170. Consequently, each of these embodiments of the invention enables improved range of motion with respect to each degree of freedom of the pad plate 202 and support pad 220 relative to the patient 101 to enable the support assembly 100 to find the optimal support for the patient 101 on the OR table 102 for a surgical procedure.

Referring to FIGS. 4 and 5, the support system 100 according to the invention is characterized in that the support system 100 comprises a third supporting element 190 mounted to the opposite lateral edge side rail 103 of an operating table 102 relative to the first support unit 110. The provision of third supporting element 190 results in increased patient's stability by supporting the lower anterior iliac crest and/or pelvic area 199 of the patient 101. The third supporting element 190 comprises a rail clamp with a knob 192 for securing to the side rail 103, a bottom plate 194, and an arm 196 with a cross bar 196*a* configured to receive the pad 198 on an end of the arm 196 located apart from the side rail 103 for positioning and supporting the lower anterior iliac crest and/or pelvic area 199 of the patient 101. Consequently, the arm 196 may be fixed to the side rail 103 by the mounting clamp and supported in a horizontal position by the bottom plate 194 to enable the support assembly 100 to find the optimal support the lower anterior iliac crest and/or pelvic area 199 of the patient 101 on the OR table 102 for a surgical procedure.

While certain configurations of structures have been illustrated for the purposes of presenting the basic structures of the present invention, one of ordinary skill in the art will appreciate that other variations are possible which would still fall within the scope of the appended claims and additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A support system for a side rail on lateral edge of an operating table for positioning patient in lateral position during surgery procedures, comprising:

a first support unit comprising a bottom plate, a first high adjustable arm and a second length adjustable arm, said first support unit configured for supporting a lumbar area of the patient; and a second support unit comprising an arm for positioning a pad plate connected to a support plate with a support pad adjacent to the patient, said second support unit connected to said second length adjustable arm extending over said patient, and said arm configured to position said support pad adjacent an iliac crest of said patient;

characterized in that a connection between said second length adjustable arm and said arm for providing translatable and rotatable degrees of movement of said arm relative to said second length adjustable arm;

a connection between said arm and said pad plate for providing continuously pivotable and continuously rotatable degrees of movement between said pad plate relative to said arm; and said support plate comprises a biasing connector formed in segmented protrusions from an upper surface thereof, said biasing connector comprising a groove formed by a base plate support segment and a projection adapted to receive said pad plate therein, said pad plate configured for operably connecting to said support plate and permitting an angular rotational movement of said support pad in relation to said pad plate.

2. A support system according to claim 1, wherein the support plate is angularly rotationally movable around said pad plate under the influence of an external force F1 exceeding a threshold value.

3. A support system according to claim 1, wherein said biasing connector is made of elastic plastic material, resistant to bending and abrasions.

4. A support system according to claim 1, wherein said biasing connector comprises intervals formed by openings between each segmented projection of said biasing connector, said biasing connector is arranged on an upper surface of said support plate.

5. A support system according to claim 4, wherein a lip is formed in said projection of said biasing connector, said lip configured inclined at an angle relative to the support plate upper surface.

6. A support system according to claim 1, wherein said support pad is configured in an oval shape and made of compressive foam material.

7. A support system according to claim 1, wherein said connection comprises a pin adapted to be received in openings formed in a post of said pad plate and formed adjacent a slot in said arm, said pin being configured for passing through said openings arranged adjacent each other to operatively connect said pad plate to said arm for allowing movement of said pad plate relative to said arm.

8. A support system according to claim 1, wherein said connection comprises ball and socket connector, said ball and socket connector configured with a body portion adapted to be received in said arm and a socket portion for receiving a ball post of said pad plate for allowing movement of said pad plate relative to said arm.

9. A support system according to claim 1, whereby said support system comprises a third support element comprising an arm, a crossbar and a tubular support pad adapted to be received on said crossbar, said third support element configured to be mounted to a side rail on an opposite lateral edge of the operating table relative to the first support unit, said a third support element having said arm oriented horizontal to the plane of the operating table secured to said side rail by a mounting clamp, wherein said third support element adapted to position said crossbar adjacent a pelvic area and/or iliac crest to support of said patient in a desired position.

10. A support system according to claim 1, wherein said biasing connector comprises intervals formed by openings between each segmented projection of said biasing connector, said biasing connector is arranged on an upper surface of said support plate.

11. A support system according to claim 10, wherein a lip is formed in said projection of said biasing connector, said lip configured inclined at an angle relative to the support plate upper surface.

12. A support system according to claim 11, wherein said support plate further comprises an opening between a lower surface and an upper surface of said support plate extending there through.

13. A support system according to claim 12, wherein said support plate further comprises an opening between a lower surface and an upper surface of said support plate extending there through.

14. A support system according to claim 13, wherein an edge of said pad plate is configured in a diameter lower than a diameter of said biasing connector on said plane of which said biasing connector is arranged.

15. A support system for a side rail on lateral edge of an operating table for positioning patient in lateral position during surgery procedures, comprising:

a first support unit comprising a bottom plate, a first high adjustable arm and a second length adjustable arm, said first support unit configured for supporting a lumbar area of the patient; and a second support unit comprising an arm for positioning a pad plate connected to a support plate with a support pad adjacent to the patient and having an opening between a lower surface and an upper surface of said support plate extending there through, said second support unit connected to said second length adjustable arm extending over said patient, and said arm configured to position said support pad adjacent an iliac crest of said patient, wherein said support plate further comprises;

a connection between said arm and said pad plate for providing continuously pivotable and continuously rotatable degrees of movement between said pad plate relative to said arm; and said support plate comprises a biasing connector formed in segmented protrusions from an upper surface thereof, said biasing connector comprising intervals formed by openings between each segmented projection of said biasing connector, a groove formed by a base plate support segment, and a projection adapted to receive said pad plate therein, wherein a lip is formed in said projection configured inclined at an angle relative to the support plate upper surface, said pad plate configured for operably connecting to said support plate and permitting an angular rotational movement of said support pad in relation to said pad plate, wherein said biasing connector is arranged on an upper surface of said support plate.

16. A support system for a side rail on lateral edge of an operating table for positioning patient in lateral position during surgery procedures, comprising:

a first support unit comprising a bottom plate, a first high adjustable arm and a second length adjustable arm, said first support unit configured for supporting a lumbar area of the patient; and a second support unit comprising an arm for positioning a pad plate connected to a support plate with a support pad adjacent to the patient and having an opening between a lower surface and an upper surface of said support plate extending therethrough, said second support unit connected to said second length adjustable arm extending over said patient, and said arm configured to position said support pad adjacent an iliac crest of said patient, wherein said support plate further comprises;

a connection between said arm and said pad plate for providing continuously pivotable and continuously rotatable degrees of movement between said pad plate relative to said arm; and said support plate comprises a biasing connector formed in segmented protrusions from an upper surface thereof, said biasing connector comprising intervals formed by openings between each segmented projection of said biasing connector, a groove formed by a base plate support segment, and a projection adapted to receive said pad plate therein, wherein a lip is formed in said projection configured inclined at an angle relative to the support plate upper surface, said pad plate configured for operably connecting to said support plate and permitting an angular rotational movement of said support pad in relation to said pad plate, wherein said biasing connector is arranged on an upper surface of said support plate an edge of said pad plate is configured in a diameter lower than a diameter of said biasing connector on said plane of which said biasing connector is arranged.

17. A support system according to claim 6, wherein a second support pad is configured in an oval-shape and made of a different density of compressive foam material, said second support pad being affixed to said support pad made of said compressive foam material.

* * * * *